US005573073A

United States Patent [19]

Schofield et al.

[11] Patent Number: 5,573,073

[45] Date of Patent: Nov. 12, 1996

[54] COMPRESSED FLUID OPERATED TOOL WITH FLUID METERING DEVICE

[75] Inventors: John H. L. Schofield, Lancashire; David A. Hill, Manchester; Graham Dewhurst, Lancashire; Paul J. Fairhurst, Wigan, all of England

[73] Assignee: Ingersoll-Rand Company, Woodcliff Lake, N.J.

[21] Appl. No.: 370,043

[22] Filed: Jan. 9, 1995

[30] Foreign Application Priority Data

Jan. 11, 1994 [GB] United Kingdom ..... 9400403

[51] Int. Cl.[6] ..... B25D 1/12

[52] U.S. Cl. ..... 173/17; 173/15; 173/210

[58] Field of Search ..... 173/13, 15, 17, 173/168, 169, 207, 210, 211, 212, 4, 6, 8

[56] References Cited

U.S. PATENT DOCUMENTS 3,892,279 7/1975 Amtsberg ..... 173/13

4,871,035 10/1989 Ekwall ..... 173/212

5,088,566 2/1992 Gustafsson et al. ..... 173/210 X 5,259,462 11/1993 Kimberlin ..... 173/211 X

*Primary Examiner*—Joseph J. Hail, III

*Assistant Examiner*—Jay A. Stelacone

*Attorney, Agent, or Firm*—Walter C. Vliet

[57] ABSTRACT

A vibration dampened percussive tool has a handle assembly and a cover surrounding a barrel and piston assembly which are caused to oscillate relatively to the handle assembly. The barrel assembly receives a tool retainer and a trigger controls primary air supply. To reduce air consumption when the tool is not actually applied to a workpiece and thereby to reduce exposure of the operator's hand/arm to vibration, an air metering device is provided, which includes a tube slidably mounted in a bush and having a bleed hole in an end of the tube which enters the bush. In one position of the tube within the bush, apertures in the tube are sealed to allow the tool idle and in another position of the tube the apertures are exposed. The tube connects the air line with the piston assembly and moves within the bush responsive to pressure applied by the actual tool on the workpiece.

13 Claims, 2 Drawing Sheets

COMPRESSED FLUID OPERATED TOOL WITH FLUID METERING DEVICE

Figure 1:
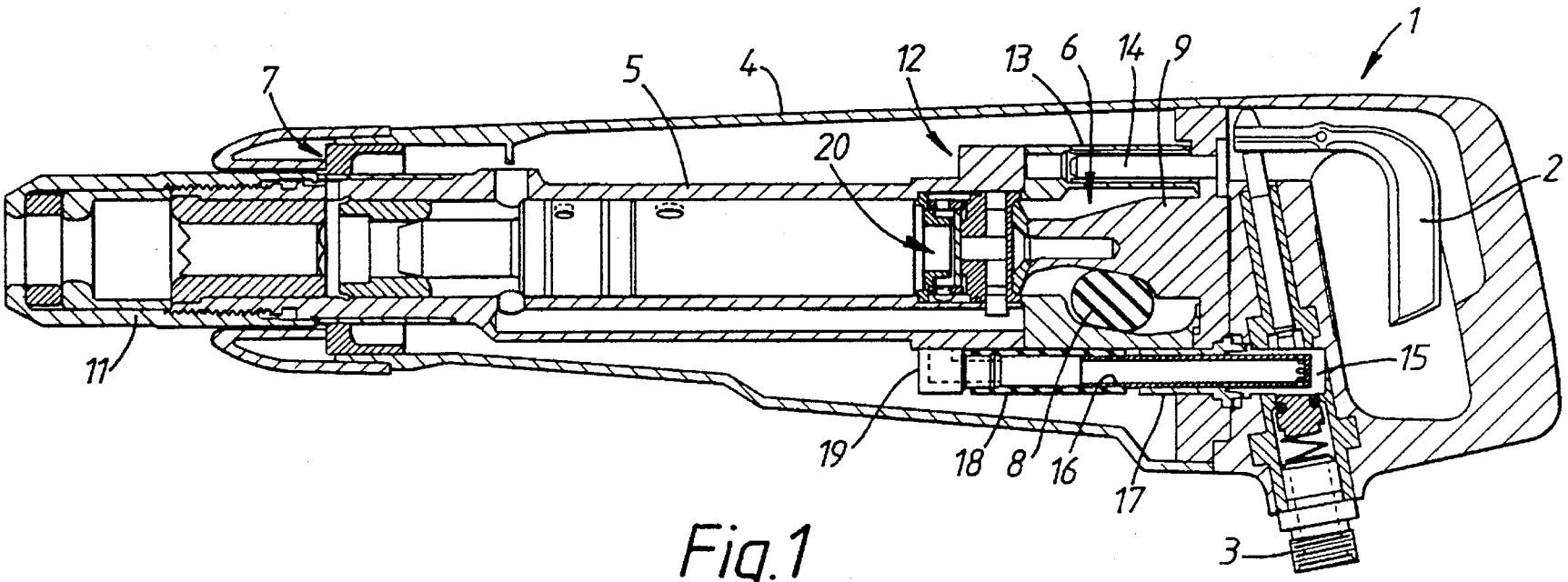

This invention relates to a compressed fluid operated tool with a fluid metering device and more particularly relates to an air metering device in a compressed air operated tool.

A vibration dampened percussive tool is known from EP-A 0 551 719, wherein an outer cover complete with handle and trigger is designed to remain still, while the barrel and piston assembly oscillates at approximately 1500 cycles per minute. In practice, this presents two important problems. Firstly, there needs to be satisfactory transfer of compressed air between the handle assembly and barrel assembly (the two relatively moving masses). Secondly, the oscillating barrel assembly can cause a working member such as a chisel (that has a free play movement of approximately 42 mm within its latch retainer) to be violently hit back and forth between the front of the barrel and the latch retainer and this can cause premature breakage of both the latch assembly and the chisel.

According to the present invention, there is provided a compressed fluid operated tool having a working part and a fluid metering device, the fluid metering device being characterized by a tube having first and second ends, part of the length of the tube being slidably mounted in a bush in sealing manner and supported for reciprocating motion, there being means to reciprocate said tube in said bush, said first end of the tube being partly closed and having at least one aperture in the peripheral wall of the tube adjacent said first end, which aperture, in a first position of the tube within the bush, is sealed by the bush and which, in a second position of the tube within the bush, is exposed; and the tube being connectable to a source of compressed fluid, which fluid is for transmission through the tube to the driving part of the tool; wherein said means to reciprocate said tube in said bush is provided by said compressed fluid to urge the tube to said first position and wherein the tube is linked to said working part of the tool so that pressure applied to said working part urges the tube towards said second position; whereby, in said first position of the tube, the compressed fluid supplied to the working part of the tool is restricted, thereby causing the tool to idle, and in said second position of the tube the compressed fluid supply is increased by opening of said at least one aperture to operate the working part of the tool.

Preferably, there are a plurality of apertures spaced around the peripheral wall of the tube.

Preferably, said first end of the tube that is partly closed is provided with a single bleed hole to permit idling of the tool when said tube is in said first position.

The invention also extends to a compressed fluid operated tool incorporating a metering device as defined above and comprising means to reciprocate said tube in said bush.

Preferably, said means to reciprocate said tube in said bush is provided (a) by a supply of compressed fluid to urge the tube to said one position and (b) the tube is linked to a working member of the tool so that pressure applied to said working member urges the tube towards said other position.

The invention has particular applicability to an air metering device for a compressed air operated tool such as the vibration dampened percussive tool described above.

Figure 2:
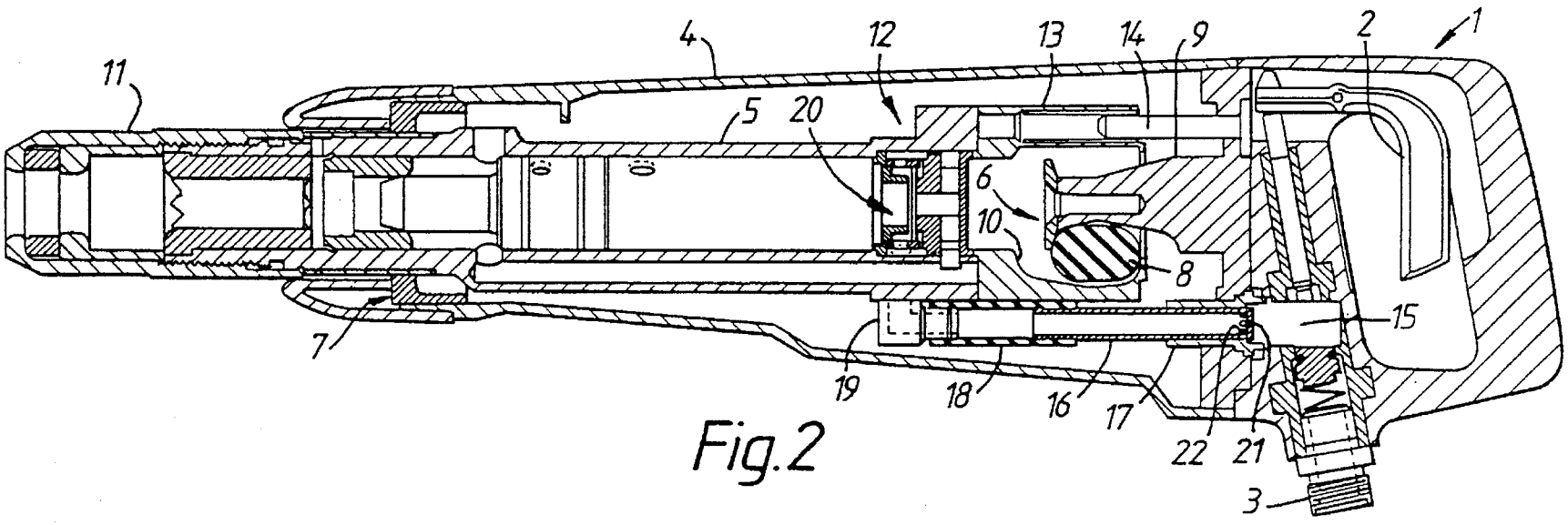
Figure 3:
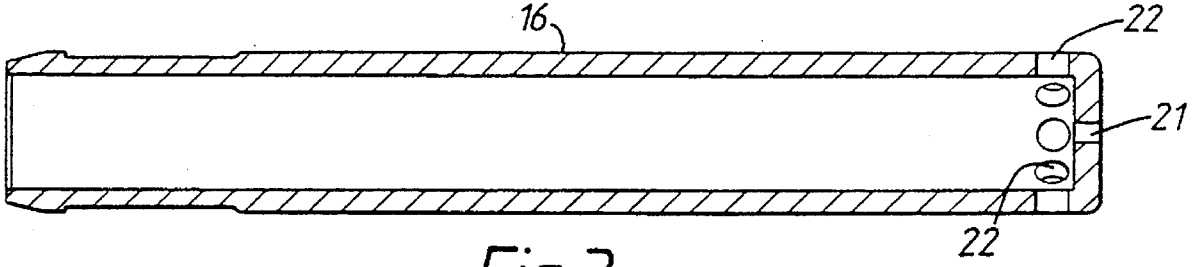

For a better understanding of the invention and to show how the same may be carried into effect, reference will now be made, by way of example, to the accompanying drawings, in which:

FIG. 1 is a sectional side view of a vibration dampened percussive tool incorporating an air metering device, the tool being illustrated in a power full on condition, FIG. 2 is a view similar to FIG. 1 but illustrating an idling condition of the tool, and FIG. 3 is an enlarged sectional side view of part of a metering device shown in FIGS. 1 and 2.

The tool is a compressed air operated tool which includes a handle assembly 1 incorporating an actuating trigger 2 for prime control of a supply of compressed air for actuating the tool, the compressed air being supplied via a compressed air line 3.

A cover 4 surrounds an oscillating barrel assembly 5, which is mounted in the cover 4 in such a way as to incorporate a first vibration dampening means 6 and a second vibration dampening means 7. The vibration dampening means 6 includes a floating, resilient ball arrangement interposed between the handle assembly 1 and the barrel assembly 5, the resilient ball arrangement comprising a plurality of balls 8 located between male and female parts 9 and 10 respectively.

The end of the barrel assembly 5 remote from the handle assembly 1 carries a retainer for a tool such as a chisel, chipper, digger, needle gun, scaler, hammer drill or a demolition tool. In the form illustrated, the retainer is a screw retainer 11 but this screw retainer 11 can be substituted by a latch retainer or hitchcutter retainer (not shown).

The end of the barrel assembly 5 nearest the handle assembly 1 incorporates a piston assembly 12 which is mounted for reciprocating axial motion by means of at least one tube or guideway 13 slidably mounted on a corresponding spigot 14 which is fixed relatively to the handle assembly 1.

Compressed air supply for the piston assembly 12 is via the air line 3, a bore 15 containing an actuating part of the trigger 2, a steel tube 16 slidably mounted in a bush 17, a flexible hose 18, an elbow 19 and a cycle valve arrangement 20.

The tube 16 is slidably mounted in sealing manner in the bush 17 and the end of the tube 16 which, in one position of the tube, lies within the bush 17 (see FIG. 2) is closed save for an air bleed hole 21, best seen in FIG. 3. The opposite end of the tube 16 is open and is securely fitted within one end of the hose 18. The opposite end of the hose 18 is securely fitted about the elbow 19. The elbow 19 is screwed into the barrel assembly 5 to link the air supply to the valve 20 and the piston assembly. A portion of the actuating part of the trigger 2 is out of the plane of the steel tube 16 as viewed in the drawings so as not to foul movement of the steel tube 16.

The peripheral wall of the tube 16 adjacent the bleed hole 21 is provided with a plurality of apertures 22 spaced around the periphery of the tube.

Referring to FIG. 2, it will be noted that, when the end of the tube 16 adjacent the bleed hole 21 is within the bush 17, then the apertures 22 are sealed by the bush so that compressed air can only flow to the piston assembly 12 through the bleed hole 21 from the air supply line 3. Pressure of air on the partly closed end of the tube 16 biasses the tube 16 to the condition shown in FIG. 2 and, since the tube 16 is linked by the hose 18, elbow 19 and barrel assembly 5 to the tool retainer 11, it will be noted that the retainer 11 is caused to protrude some distance from the open end of the cover 4. When an operator of the tool applies the chisel or other tool to a workpiece, this has the effect of pushing the retainer 11 further into the cover 4, which thereby causes the barrel assembly 5 and the tube 16 linked to it to move to the right as shown in FIGS. 1 and 2 so as eventually to achieve the position shown in FIG. 1, where the apertures 22 are fully exposed to the compressed air supply in the bore 15 and this applies full power to the tool.

Once pressure is taken off the working members, such as the chisel, by removing it from the workpiece, the tube 16 will again be urged back through the bush 17 to the position shown in FIG. 2 where the apertures 22 are closed by the bore 17, thereby to restrict the supply of air to the piston assembly 12, which brings the tool to its idling condition, in which it operates at a lesser speed of oscillation and at less power.

It will be appreciated that this arrangement allows for automatic reduced air consumption when the working member is not actually being applied to a workpiece while being able to dramatically increase the life of the actual tool such as the chisel, while reducing the load on the retainer, whether it be a screw retainer, a hitchcutter retainer or a latch retainer. The retainers are usually high wear items.

In addition, it will be appreciated that the metering device constituted by the tube and bush provides operator control for spotting, i.e. it allows a reduction of walking and skipping on the workpiece by the chisel point. Furthermore, the device significantly reduces tool vibration under the no-load or idling conditions and hence reduces the exposure of the operator's hand/arm to vibration.

The size and the location of the apertures 22 in the tube 16 control the working characteristics of the tool and therefore changes can be made to tune a tool to a particular operator's requirements. As shown, there is an element of graduation because, as the operator gradually increases pressure on the workpiece, there comes a point where the apertures 22 are at one point in the cycle exposed and at another point in the cycle closed. Other possible arrangements of apertures includes one or more further rings of apertures around the tube or a spiral arrangement of apertures.

Because of the extremely high G-forces that are present within the barrel assembly, it is important that the materials of the various assemblies are chosen carefully. For example, it is preferred that the elbow 19 is injection moulded from a composite material and similarly the bush 17. The tube 16 can be made of ground steel pipe.

More than one bleed hole 21 can be provided in the end of the tube 16 if required.

What is claimed is:

1. A compressed fluid operated tool having a working part and a fluid metering device, the fluid metering device comprising: a tube having a peripheral wall and first and second ends, said first end of the tube being partly closed; at least one aperture in the peripheral wall of the tube adjacent said first end; a bush; part of the length of the tube being slidably mounted in said bush in sealing manner and being supported for reciprocating motion between a first position and a second position therein; means to reciprocate said tube in said bush; and a source of compressed fluid, said tube being connected to said source of compressed fluid, which fluid is transmitted through the tube to the working part of the tool; wherein said aperture, in said first position of the tube within the bush, is sealed by the bush and wherein, in said second position of the tube within the bush, is exposed; said means to reciprocate said tube in said bush being comprised by said compressed fluid to urge the tube to said first position; the tube being linked to said working part of the tool so that pressure applied to said working part urges the tube towards said second position; whereby, in said first position of the tube, the compressed fluid supplied to the working part of the tool is restricted, thereby causing the tool to idle, and in said second position of the tube the compressed fluid supply is increased by opening of said at least one aperture to operate the working part of the tool.

2. A compressed fluid operated tool according to claim 1, further comprising a single bleed hole in said first end of the tube that is partly closed, said single bleed hole permitting the idling of the tool when said tube is in said first position.

3. A compressed fluid operated tool according to claim 1, further comprising a flexible hose having one end, the second end of the tube remote from said first end being securely fitted within said one end of said flexible hose.

4. A compressed fluid operated tool according to claim 3, further comprising an elbow pipe, wherein said flexible hose has an end opposite to said one end, said opposite end being securely fitted with said elbow pipe, which connects said fluid metering device to said driving part of the tool.

5. A compressed fluid operated tool according to claim 1 and being in the form of a compressed air operated tool.

6. A compressed fluid operated tool according to claim 5 and being in the form of a vibration dampened percussive tool.

7. A compressed fluid operated tool according to claim 1 and being in the form of a compressed air operated, vibration dampened chisel.

8. A compressed fluid operated tool according to claim 1 and being in the form of a compressed air operated, vibration dampened chipper.

9. A compressed fluid operated tool according to claim 1 and being in the form of a compressed air operated, vibration dampened digger.

10. A compressed fluid operated tool according to claim 1 and being in the form of a compressed air operated, vibration dampened needle gun.

11. A compressed fluid operated tool according to claim 1 and being in the form of a compressed air operated, vibration dampened scaler.

12. A compressed fluid operated tool according to claim 1 and being in the form of a compressed air operated, vibration dampened hammer drill.

13. A compressed fluid operated tool according to claim 1 and being in the form of a compressed air operated, vibration dampened demolition tool.

* * * * *